United States Patent [19]

Brand

[11] Patent Number: 4,714,903

[45] Date of Patent: Dec. 22, 1987

[54] DIELECTRIC RESONATOR DIRECTIONAL FILTER

[75] Inventor: Jerry C. Brand, Scottsdale, Ariz.

[73] Assignee: Motorola, Inc., Schaumburg, Ill.

[21] Appl. No.: 876,607

[22] Filed: Jun. 20, 1986

[51] Int. Cl.[4] ..... H01P 1/213; H01P 7/10; H01P 5/18

[52] U.S. Cl. ..... 333/110; 333/202; 333/204; 333/219

[58] Field of Search ..... 333/202, 204, 205, 208–212, 333/219, 227, 235, 245, 246, 1, 103, 104, 110, 111, 129, 132, 133

[56] References Cited

U.S. PATENT DOCUMENTS

| | | | |
|---|---|---|---|
| 3,512,110 | 5/1970 | Clar | 333/116 |
| 3,611,197 | 10/1971 | Moore et al. | 333/204 X |
| 3,742,390 | 6/1973 | Stiglitz et al. | 333/134 |
| 4,287,605 | 9/1981 | Dydyk | 333/110 X |
| 4,477,785 | 10/1984 | Atia | 333/202 |

*Primary Examiner*—Marvin L. Nussbaum

*Attorney, Agent, or Firm*—Maurice J. Jones, Jr.; Eugene A. Parsons

[57] ABSTRACT

A directional filter wherein dielectric resonators tuned to the operating frequency couple electric energy from port one to port four while electrical energy at other frequencies passes through the filter to port two.

2 Claims, 6 Drawing Figures

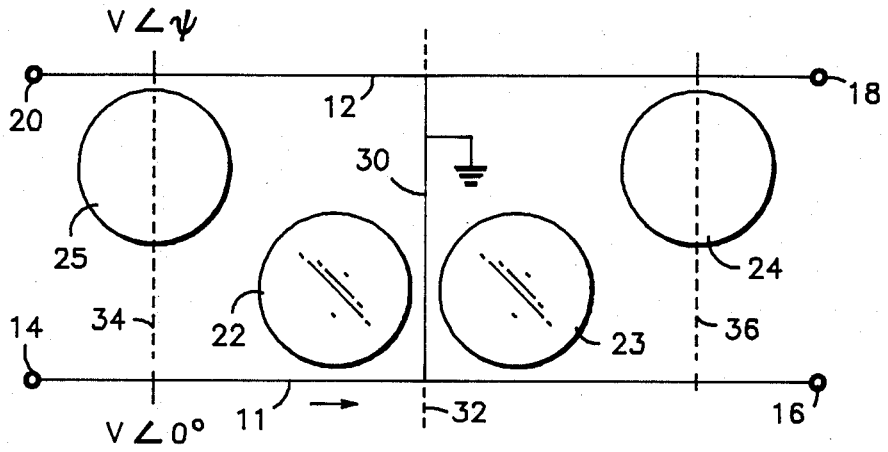
FIG. 4
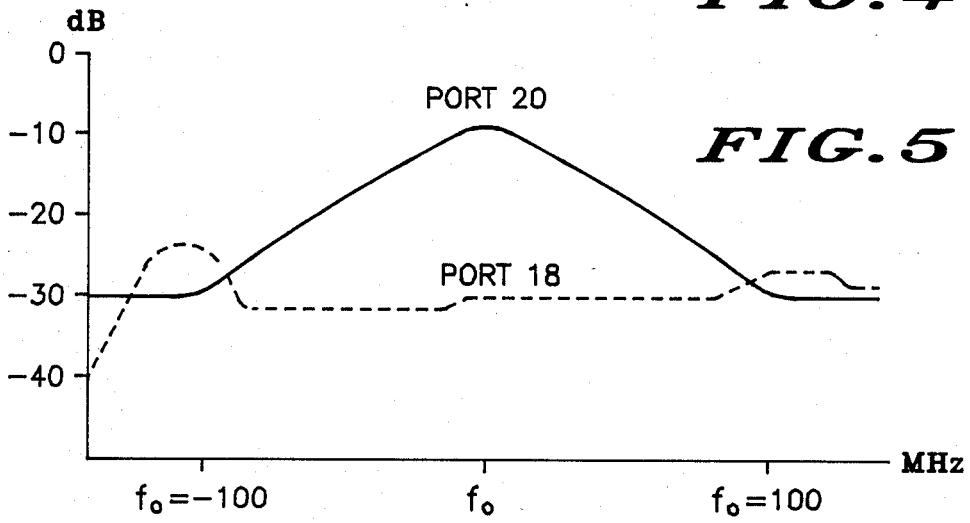
FIG. 5
FIG. 6
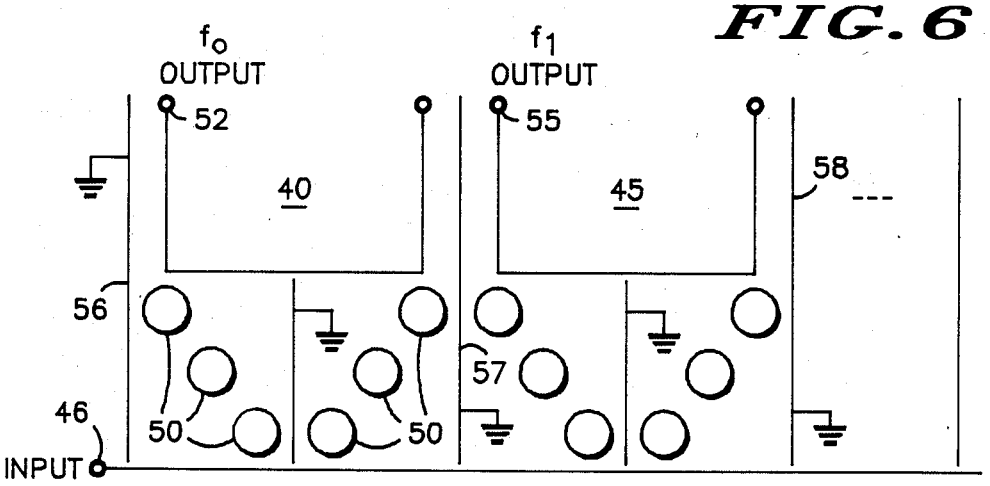

DIELECTRIC RESONATOR DIRECTIONAL FILTER

BACKGROUND OF THE INVENTION

The present invention pertains to directional filters and specifically to directional filters in the microwave or millimeter wave frequencies. Generally, a directional filter is a four port device with the ports being numbered clockwise, from an input port, one through four. Directional filters are well-known in the art and have been used for years in applications wherein a signal formed of a plurality of frequencies is applied to the input port and the operating or selected frequency is filtered out and available at port four. The remainder of the input signal (all of the unselected frequencies) is available at port two. A typical prior art directional filter is disclosed in U.S. Pat. No. 4,287,605, entitled "Directional Filter for Mixers, Converters and the Like", issued Sept. 1, 1981. The directional filter disclosed in this patent is large, relatively complicated to construct, and difficult to cascade to form channelized filter, and the like.

SUMMARY OF THE INVENTION

The invention pertains to a dielectric resonator directional filter including a four port coupler with dielectric resonators magnetically coupled to the coupler and to each other and positioned along the coupler so that substantially all electric energy at an operating frequency applied to an input port of the four ports of the coupler appears at an output port of the four ports of the coupler. All four ports are loaded in their characteristic impedance. In a specific embodiment the four port coupler includes two parallel spaced apart transmission lines with two dielectric resonators positioned one-quarter wavelength apart and each magnetically coupled to a first transmission line and two dielectric resonators positioned three-quarters of a wavelength apart and each magnetically coupled to the second transmission line and to the first two dielectric resonators. A shield is positioned between the dielectric resonators to separate the first two resonators and to separate the second two resonators so that there is no magnetic coupling therebetween.

It is an object of the present invention to provide a new and improved dielectric resonator directional filter.

It is a further object of the present invention to provide a new and improved dielectric resonator directional filter which is simpler to manufacture smaller and easy to cascade into a channelizer.

It is a further object of the present invention to provide a new and improved dielectric resonator directional filter which is more easily tuned.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures:

FIG. 4 is a schematic diagram of the directional filter illustrated in FIG. 1, illustrating the total input and output signals;

FIG. 5 is a graphical representation of the outputs in the directional filter of FIGS. 1 and 4; and FIG. 6 is a schematic diagram of a plurality of directional filters cascaded to form a channelizer.

DESCRIPTION OF THE PREFERRED EMBODIMENTS

Figure 1:
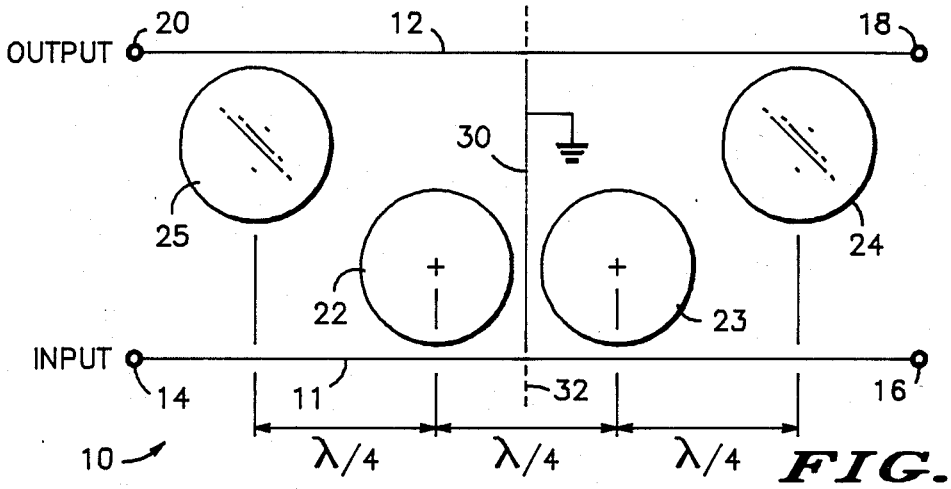
FIG. 1 is a schematic diagram of a dielectric resonator directional filter embodying the present invention.

Referring specifically to FIG. 1, a dielectric resonator directional filter, generally designated 10, is illustrated. Filter 10 includes a four port coupler, which in this preferred embodiment is a first transmission line 11 and a second transmission line 12 parallel to and spaced from transmission line 11. Transmission lines 11 and 12 can be microstrip, strip line, coax, or any other well-known transmission line and are not coupled. Transmission line 11 has a first port 14, which serves as an input for filter 10, and a second port 16. Transmission line 12 has a third port 18 and a fourth port 20, which serves as an output for filter 10. Filter 10 also includes four dielectric resonators 22 through 25. Dielectric resonators 22 through 25 may be, for example, any of the well-known ceramic resonators formed of materials such as barium titanate, barium tetratitanate, etc.

Resonators 22 and 23 are positioned adjacent to transmission line 11 so as to be coupled thereto by magnetic field lines. Similarly, resonators 24 and 25 are positioned adjacent transmission line 12 so as to be coupled thereto by magnetic field lines. Additionally, resonator 22 is magnetically coupled to resonator 25 and resonator 23 is magnetically coupled to resonator 24. A grounded shield 30 is positioned between resonators 22 and 23 and between resonators 24 and 25 so that no magnetic coupling occurs therebetween.

Resonators 22 and 23 are equally spaced on either side of a dividing line 32, which in this embodiment extends through shield 30. It should be understood by those skilled in the art that shield 30 might be positioned somewhat differently and is illustrated on dividing line 32 for convenience. Further, shield 30 is positioned to shield resonators 22 and 25 from 23 and 24 but does not electrically contact transmission lines 11 and 12. Resonators 22 and 23 are spaced equal distances from dividing line 32 and are positioned one-quarter wavelength apart. The wavelength of interest is the operating frequency of filter 10. Resonators 24 and 25 are spaced equal distances from dividing line 32 and are spaced three-quarters of a wavelength apart. Each of the resonators 22 through 25 are designed to resonate at the operating frequency. Generally, the diameter of each of the resonators 22 through 25 will be equal to $2.25/F_o$, where $F_o$ is the operating frequency in GHz. Also, each of the resonators 22 through 25 is formed as a circular cylinder (circular cross section) with the height being approximately equal to 0.4 times the diameter. While the resonators are illustrated as circular cylinders it will be understood by those skilled in the art that many other forms or configurations might be utilized, such as retangular cross section, etc.

In the preferred embodiment illustrated in FIG. 1, a multi-frequency signal is applied to input port 14 and all of the frequencies of the input signal, except the operating frequency ($F_o$) appear at port 16 for further utility. Operating frequency, $F_o$, appears at output port 20. Port 18, of transmission line 12, has no signal appearing thereat. A simplified explanation of the manner in which $F_o$ is filtered from the input signal is described in conjunction with FIGS. 2–4.

Figure 2:
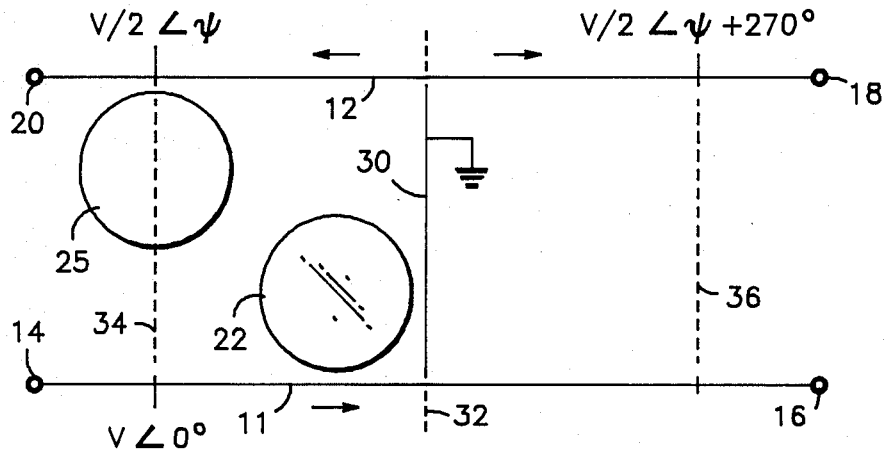
FIG. 2 is a schematic diagram of a portion of the directional filter illustrated in FIG. 1.

Referring specifically to FIG. 2, only the operation of resonators 22 and 25 is illustrated. Resonators 22 and 25, by themselves, operate similar to a power divider in that electrical energy at the operating frequency in transmission line 11 induces energy into resonator 22 which in turn induces energy into resonator 25. Resonator 25 induces energy into transmission line 12 with one-half of the energy appearing at a point on transmission line 12 defined by center line 34 (center of resonator 25) at a phase angle $\psi$ and the remaining half of the energy appearing at a point on transmission line 12 defined by a center line 36 (center of resonator 24) with a phase angle of $\psi+270°$. The 270° phase difference between the energy at center line 34 and center line 36 is caused by the 270° difference in position between resonators 25 and center line 36.

Figure 3:
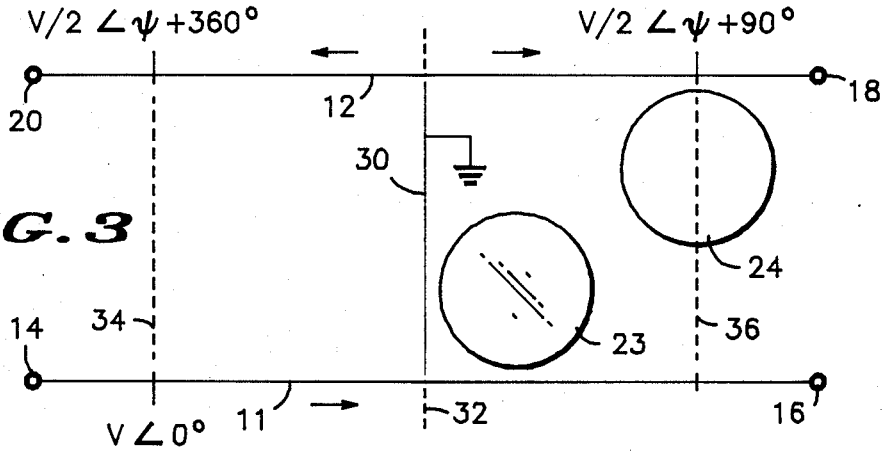
FIG. 3 is a schematic diagram of another portion of the directional filter illustrated in FIG. 1.

Referring to FIG. 3, only resonators 23 and 24 are illustrated so that their effect on the directional filter can be seen. Electrical energy from transmission line, at the operating frequency, is induced into resonator 23, which in turn induces electrical energy into resonator 24. As in the case of resonators 22 and 25, resonators 23 and 24 operate like a power divider and resonator 24 induces electrical energy into transmission line 12 so that half of the energy appears at the point defined by center line 34 with a phase angle of $\psi+360°$ and the remaining half of the energy appears at a point on transmission line 12 defined by center line 36 at a phase angle of $\psi+90°$. Again, the 270° phase angle difference between the energy at center line 34 and the energy at center line 36 is produced by the 270° difference in position between resonators and 24 center line 34.

Referring to FIG. 4, the net effect of the power divider illustrated in FIG. 2 and the power divider illustrated in FIG. 3 is shown. Since the power divider formed by resonators 22 and 25 provides half of the energy induced thereby at center line 36 with a phase angle of $\psi+270°$ and since the power divider formed by resonators 23 and 24 provides half of the energy induced thereby at the same point with a phase angle of $\psi+90°$, it can be seen that the resultant of the two energies at the same amplitude and 180° out of phase is zero. Thus, the total energy at port 18 is zero. Further, since the energy induced in line 12 by the power divider, resonators 22 and 25, is half the energy at an angle of and the energy induced in line 12 by the other power divider, resonators 23 and 24, is half the energy at an angle of $\psi+360°$, the resultant energy is equal to the total energy supplied at input port 14 at a phase angle of $\psi$. Thus, a multi-frequency signal supplied to input port 14 is filtered so that the portion of the input signal at the operating frequency, $F_o$, appears at output port 20 while the remainder of the input signal passes on to port 16. Referring to FIG. 5, the graphical representation of the filtering characteristics for directional filter 10 are illustrated. The frequency versus amplitude waveform for port 18 is illustrated in dotted lines and the frequency versus amplitude waveform for port 20 is illustrated in solid lines.

Referring to FIG. 6, a plurality of directional filters, similar to that in FIG. 1, are cascaded to form a channelizer. The channelizer of FIG. 6 is formed of a first directional filter 40, a second directional filter 45, and additional directional filters, not illustrated. Directional filter 40 has a signal input port 46 which serves as the input port for the entire channelizer. Directional filter 40 is tuned to an operating frequency $F_o$ by a plurality (in this embodiment 6) of dielectric resonators 50. Dielectric resonators 50 are positioned so that all of the electrical energy applied to input port 46 at the frequency $F_o$ appears at an output port 52. The remainder of the electrical energy supplied to input port 46 is applied to an input port of directional filter 45. Directional filter 45 is tuned to some predetermined second frequency, $F_1$, and all of the electrical energy at that frequency appears at an output port 55. Additional frequencies of interest may be filtered by additional directional filters cascaded in a similar fashion. Each of the filters is separated from the other filters by shields 56 through 58, respectively. It should be noted that any number of dielectric resonators may be used in each of the directional filters as long as the net result is to direct all of the electrical energy at the desired frequency to a single port. Further, while the port utilized in these embodiments is the fourth port of a four port directional filter, it should be understood that in some instances different phase angles may be induced and the desired electrical energy may appear at the third port, rather than the fourth port.

Thus, an improved dielectric resonator directional filter has been disclosed which is substantially simpler to manufacture and, because dielectric resonators can be formed relatively easily, is substantially easier to tune. Since it is not necessary to manufacture complicated resonant cavities and the like, the directional filter can be made smaller and is more cost efficient.

While I have shown and described specific embodiments of this invention, further modifications and improvements will occur to those skilled in the art. I desire it to be understood, therefore, that this invention is not limited to the particular forms shown and I intend in the appended claims to cover all modifications which do not depart from the spirit and scope of this invention.

What is claimed is:

1. A dielectric resonator directional filter having an operating frequency comprising:

first and second parallel spaced apart transmission lines having an input defined by the first of said transmission lines and an output defined by the second of said transmission lines;

at least four dielectric resonators positioned adjacent said transmission lines and coupled thereto by magnetic field lines, a first pair of said resonators being positioned adjacent the first transmission line and equally spaced on opposite sides of a dividing line, a second pair of said resonators being positioned adjacent the second transmission line and equally spaced on opposite sides of the dividing line, resonators on one side of the dividing line being coupled by magnetic field lines and resonators on the other side of the dividing line being coupled together by magnetic field lines, and said resonators being spaced apart along said transmission lines so that substantially all electric energy at the operating frequency applied to the input appears at the output; and a shield positioned between the first pair of resonators and between the second pair of resonators to prevent magnetic coupling between resonators of the pairs.

2. A dielectric resonator directional filter having an operating frequency comprising:

first and second parallel spaced apart transmission lines having an input defined by the first of said transmission lines and an output defined by the second of said transmission lines;

at least four dielectric resonators positioned adjacent said transmission lines and coupled thereto by magnetic field lines, a first pair of said resonators being positioned adjacent the first transmission line and equally spaced one-quarter wavelength apart at the operating frequency on opposite sides of a dividing line, a second pair of said resonators being positioned adjacent the second transmission line and equally spaced three-quarters wavelength apart at the operating frequency on opposite sides of the dividing line, resonators on one side of the dividing line being coupled together by magnetic field lines, and resonators on the other side of the dividing line being coupled together by magnetic field lines; and a shield positioned between the first pair of resonators and between the second pair of resonators to prevent magnetic coupling between resonators of the pairs.

* * * * *